United States Patent [19]

Angermann

[11] 4,360,953

[45] Nov. 30, 1982

[54] DISPLAY AND BURIAL SYSTEM

[75] Inventor: Manfred E. Angermann, Lake Geneva, Wis.

[73] Assignee: Citadel Management Services, Inc., Lake Geneva, Wis.

[21] Appl. No.: 259,045

[22] Filed: Apr. 30, 1981

[51] Int. Cl.[3] ..... A61G 17/00

[52] U.S. Cl. ..... 27/14; 27/18

[58] Field of Search ..... 27/14, 16, 17, 18, 2

[56] References Cited

U.S. PATENT DOCUMENTS

| | | | |
|---|---|---|---|
| 2,848,783 | 8/1958 | Keller, Jr. et al. | 27/18 |
| 3,060,546 | 10/1962 | Nelson | 27/18 |
| 3,151,375 | 10/1964 | Schevenell | 27/16 |
| 3,262,726 | 7/1966 | Phelps | 27/16 X |
| 3,959,859 | 6/1976 | Stein, Jr. et al. | 27/18 |

*Primary Examiner*—John D. Yasko

*Attorney, Agent, or Firm*—Wegner, McCord, Wood & Dalton

[57] ABSTRACT

A display and burial system wherein a base has a lid member associated therewith which is movable between closed and open viewing positions. A two-part link holds the lid member in open viewing position with one link part pivotally connected to the lid member and the other link part being releasably connectable to a frame member of the base by entry into a slot or recess therein when the link is partially collapsed. An end of the second link part engages a pin within the recess and, thereafter, the lid member is moved to fully open position and the link parts move to a straight-line relation wherein the link is locked to the pin within the recess and the lid member is securely held in open viewing position. A reversal of steps enables disconnection of the link from the base with the link retaining its connection to the lid member and being collapsible to a storage position within the lid member.

7 Claims, 5 Drawing Figures

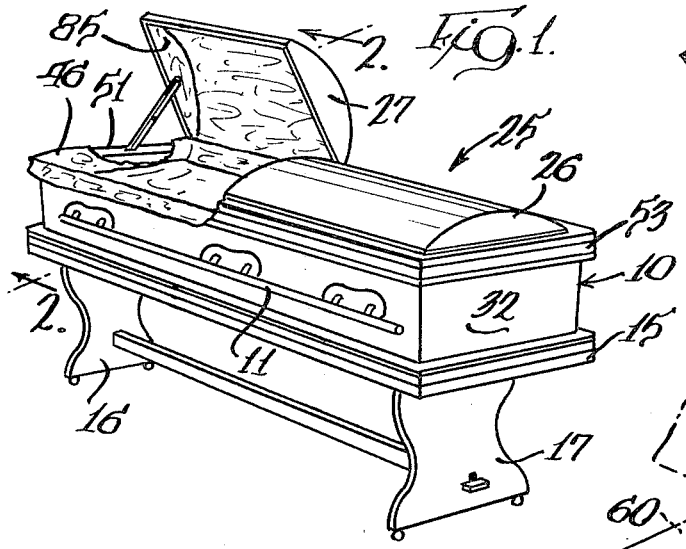
Fig. 1.
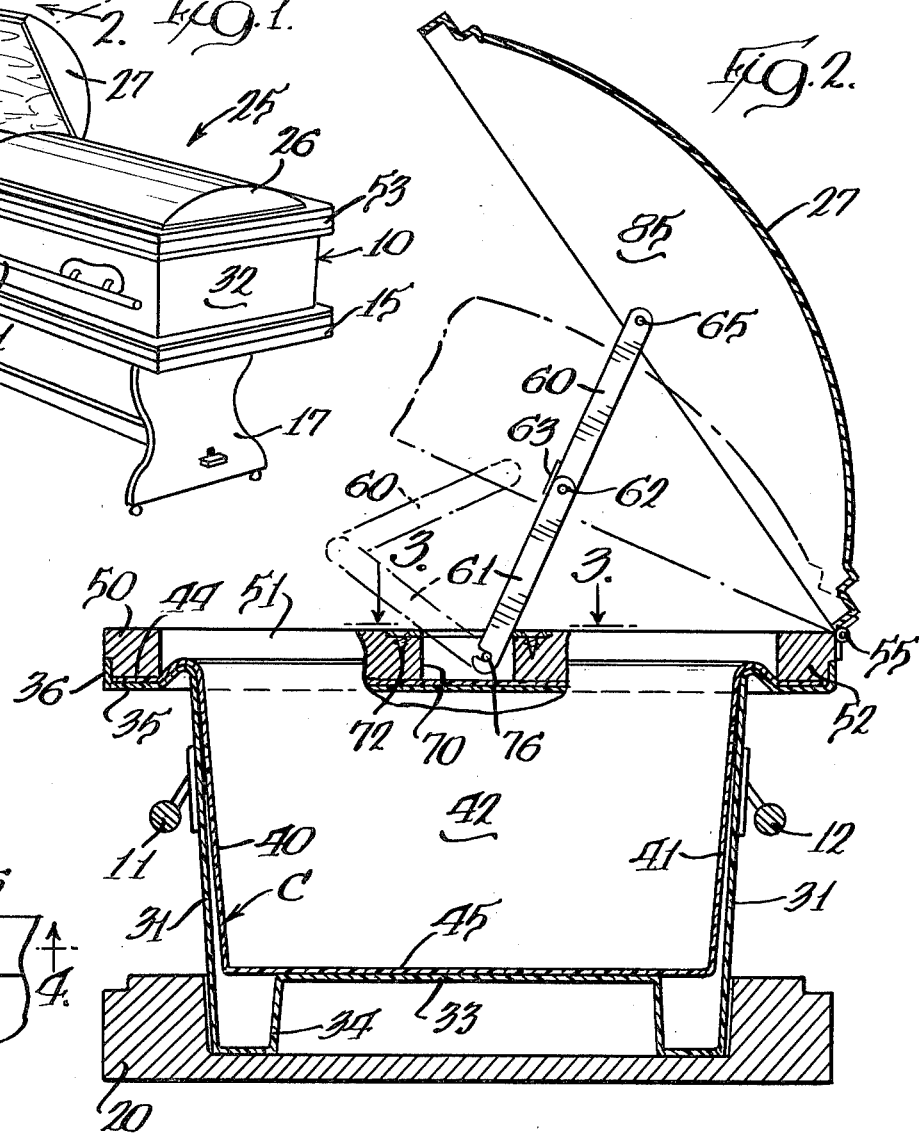
Fig. 2.
Fig. 3.
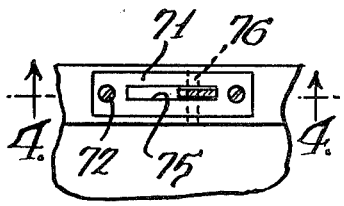
Fig. 4.
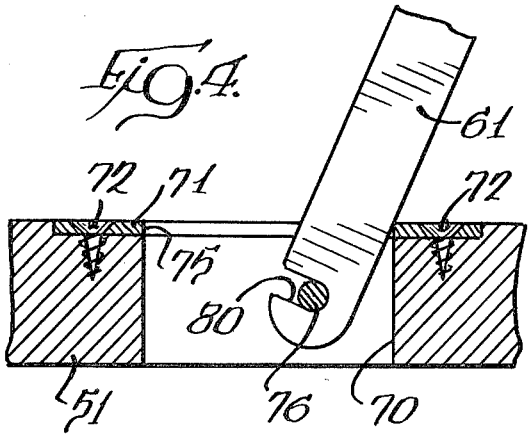
Fig. 5.
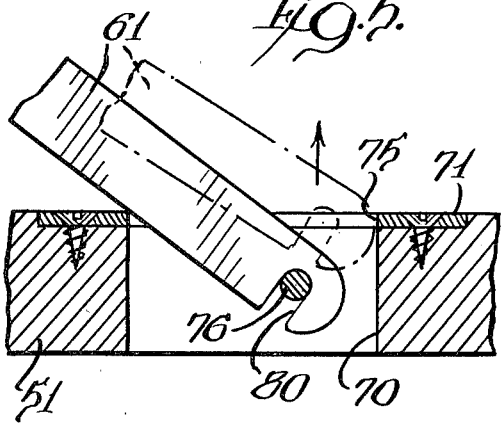

DISPLAY AND BURIAL SYSTEM

BACKGROUND OF THE INVENTION

This invention pertains to a display and burial system wherein a lid member associated with a base is held in open viewing position by a collapsible, easily stored link which can be removably connected to the base for holding the lid member in viewing position and which requires only a small opening in a frame member of the base for insertion and, therefore, only a small opening through the decorative material which is placed in and draped around the base.

There are many display and burial systems which have a base and a movable lid member associated therewith which can be moved between a closed position and an open viewing position. One common form of such system is the typical burial casket. In recent years, alternatives to the typical burial casket have been developed and, as shown in applicant's prior U.S. Pat. No. 4,177,543, a display casket encloses a display container and after viewing of the body the display container can be removed from the display casket and associated with other structure for burial or other disposition. In said previous patent, the display casket has a lid member which is held in open viewing position by a rod or link which is pivotally-connected to the display casket base and movable between a storage position provided by a groove in the base and an operative position in which it extends upwardly into engagement with the lid member. This structure requires exposure to a relatively long storage groove in the frame member of the base and therefore a lengthy opening in the decorative material which normally covers the frame member or the absence of such material.

A copending application of the applicant, Ser. No. 115,114, filed Jan. 24, 1980, shows a display and burial system wherein a display base has an appearance similar to a casket base and after viewing of the body can be associated with cover structure for burial or other disposition. A reusable casket-like movable lid unit is associated with the display base and has a hinged lid member movable between a closed and an open viewing position. It is a structure of this type which is disclosed in the drawings of this application. In the structure of said application, the lid member is held in an open viewing position by a lock bolt structure positioned at the rear of the display base.

SUMMARY OF THE INVENTION

A primary feature of the invention is to provide a display and burial system having a new and improved structure for holding a lid member in open viewing position with respect to a base.

More particularly, the invention resides in a link having two pivotally interconnected parts, with one part pivotally connected to the lid member and the other part having an end insertable into a relatively small recess in a frame member of the base for interengagement with means positioned within the recess. Thereafter, the lid member can be moved to a fully open viewing position and the link parts moved to a straight-line relation with the one link part extending into the recess firmly locked to the engaging structure positioned therein. Upon closing of the lid member, the link is moved to a partially collapsed condition to move said one link part to a position whereby it can be released from the engaging means within the recess and the link withdrawn from the recess and, thereafter, the link parts are associated only with the lid member and the lid member can be fully closed. With this structure, decorative material which is positioned within the base and normally positioned outwardly across the top thereof need only have a small buttonhole opening over the recess in the frame member to permit insertion and removal of the link part which coacts with the engaging means within the recess.

An object of the invention is to provide a display and burial system having a link structure for holding a lid member in open viewing position and which can readily be moved between operative and inoperative positions and which embodies the features set forth above.

BRIEF DESCRIPTION OF THE DRAWING

FIG. 1 is a perspective view of the display base and lid unit arranged for viewing;

FIG. 2 is a vertical section, taken generally along the line 2—2 in FIG. 1 and on an enlarged scale;

FIG. 3 is a fragmentary plan view, taken generally along the line 3—3 in FIG. 2;

FIG. 4 is a sectional view on an enlarged scale, taken generally along the line 4—4 in FIG. 3; and FIG. 5 is a view similar to FIG. 4 showing a link part in different full line and broken line positions.

DESCRIPTION OF THE PREFERRED EMBODIMENT

The display and burial system is shown generally in FIG. 1 and has a base, generally indicated at 10, which is a display base with handle structure 11 and 12 on opposite sides thereof. The display base rests on a portable support table having a top 15 and depending legs 16 and 17.

A separate sub-base 20 surrounds the exterior of the lower part of the display base to enhance the casket appearance of the display base.

A lid unit, indicated generally at 25, covers the display base and has a pair of lid members 26 and 27 which cover the display base and with the lid member 27 being movable to an open viewing position, as shown in FIG. 1, and full line in FIG. 2.

The link structure embodying the invention for holding the lid member 27 in open viewing position can be associated with many different caskets or casket-type structures and, for purposes of illustration, the structure is shown in association with a display and burial system structure of the type disclosed in the previously-mentioned application, Ser. No. 115,114.

The display base has front and rear walls 31 connected by side walls, one of which is shown at 32, and a bottom 33 positioned within the sub-base 20 and provided with a peripheral depending leg 34 which closely engages the interior surface of the sub-base. The display base 10 has support means, in the form of a shelf 35, extending around the upper periphery thereof and an upstanding flange 36 extends along the outer edge of the shelf 35.

A display container C is positionable within the display base and has front and rear walls 40 and 41 and end walls, one of which is shown at 32, and with an outwardly-extending peripheral flange 44 at the upper edge thereof which extends outwardly over the shelf 35 and supports the display container C within the display base. Added support is provided by a bottom 45 of the display container resting on the bottom 33 of the display base. The display base and display container, together, define structure for holding a body, with there being suitable upholstery decorative treatment to the interior of the display container which is omitted in the view of FIG. 2, but which is shown in FIG. 1. This type of material is well known and normally includes a layer of material 46 which extends outwardly over and downwardly from the perimeter of the display base.

The lid unit 25 in the disclosed structure is a reusable unit which is removably associated with the display base and has a perimetral frame extending around the lower part thereof provided by lengths 50–53 of a member having a generally L-shaped cross section to rest upon the support shelf of the display base.

The lid member 27 is hinged to the perimetral frame member 52 by a hinge 55 whereby the lid member can move between open and closed positions. In a display unit having a permanent cover, there would be an integral frame member comparable to the frame member 51.

The holding of the lid member 27 in open viewing position is by means of structure including a link having a first link part 60 and a second link part 61. The link parts are pivotally connected together at one of their ends by a pivot pin 62 and, as known in the art, the link part 60 carries an abutment 63 which engages the link part 61 to limit the pivoting of the link parts beyond the straight-line end-to-end relation shown in FIG. 2. The first link part 60 is fixed to the lid member 27 by a pivot pin 65, while the second link part 61 is detachably connectable to the display base.

The frame member 51 of the display base has a recess 70 therein which is covered by a cover plate 71 recessed into the top surface of the perimetral frame member 51 and secured thereto by suitable attaching means, such as screws 72. The cover plate 71 has an elongate slot 75 permitting access to the interior of the recess 70. An engageable member in the form of a pin 76 is fixed within the recess and extends generally parallel to the front of the display base. This pin defines an engageable member for engagement by the second link part 61 and with this engagement shown in FIG. 2 and with the parts positioned to securely hold the lid member in open viewing position.

The second link part 61 has an open-ended slot 80 to receive the pin 76 and with slot 80 opens toward the front of the display base when the lid is held in open position and as shown in FIGS. 2 and 4. When the lid member is to be closed, the link parts 60 and 61 are moved toward the broken line partially-collapsed position shown in FIG. 2 which results in rotation of the link part 61 from the position shown in FIG. 4 to the position shown in FIG. 5 wherein the open-ended slot 80 faces generally downwardly. The link part 61 can be rotated upwardly in the direction of the arrow to the broken line position of FIG. 5 to move the link part away from the pin 76. The link is then connected solely to the lid member and may be moved beyond the broken line position of FIG. 2 to a fully-collapsed position and readily fit within the lid member 27 and rest on the frame member 51 as the lid member is closed. With the pivot connection of the first link part 60 at 65 to an interior end face 85 of the lid member, the collapsed link can be in a storage position which does not interfere with full closure of the lid member against the display base.

The lid member is held firmly in open viewing position since the link parts cannot pivot beyond the position shown in FIG. 2 and in this position the engagement of the slot 80 with pin 76 is maintained because an edge of the second link part 61 engages against an edge of the recess 70 and, more specifically, against an end of the slot 75 formed in the cover plate 71.

The closed lid member 27 can be raised to an open viewing position and, during this process, the link is in a partially-collapsed condition and, at the time that the link part 61 is oriented as shown in the broken line position of FIG. 5, the link part can be rotated downwardly to bring the slot 80 into engagement with the pin 76 and then the lid member is fully raised to bring the link to the straight-line position of FIG. 2.

With the structure disclosed herein, the decorative material provided in the display base as well as extending over the perimetral frame member can be continuous except for a buttonhole-type opening overlying the slot 75 in the cover plate 71 to permit insertion and removal of the second link part 61 relative to the recess 70. There is no need to have a substantial length of the perimetral frame member exposed to provide an elongate storage groove, as shown in my previously-referred to U.S. Pat. No. 4,177,543. The collapsible link provides a structure which can readily be stored and the coaction between the pin 76 and open-ended slot 80 provides a positive holding of the link to assure that the lid member is securely held in open viewing position.

I claim:

1. A display and burial system including a display base having an appearance similar to a casket base and having support means along the upper perimeter thereof, a reusable casket-like movable lid unit removably supported by said support means to enable member, a lid member pivotally mounted to said frame member for raising to a viewing position, a two-part link carried by the lid member for holding the lid member in raised position, and means operable by rotation of one part of the link for releasably connecting said one part of the link to said perimetral frame member.

2. A system as defined in claim 1 wherein said perimetral frame member has a recess therein, and said releasable connection means includes an engageable member fixed in said recess and a slot adjacent an end of said one link part for positioning of said engageable member therein.

3. A system as defined in claim 2 wherein the parts of said link are pivotally interconnected at adjacent ends, and means for holding said link parts in rigid end-to-end relation when said engageable member is in said slot.

4. A display and burial system comprising, a base usable during viewing of a body and subsequently as a vault base for burial, a reusable lid unit removably associated with said base and having a perimetral frame on the underside thereof which rests on said base, said lid unit including a lid member pivotally mounted on said frame for movement to a viewing position, and a two-part link movable to an extended position for holding said lid member in viewing position including a first link part pivotally fixed to said lid member and a second link part pivotally connected at one end to the first link part and at its other end having means operable by link pivotal movement for releasable connection to said perimetral frame.

5. A system as defined in claim 4 wherein said perimetral frame member has a recess, a pin fixed in said recess, and said means on the second link part for releasable connection to said perimetral frame comprises an open-ended slot for positioning on said pin, said link coacting with said recess to prevent disengagement of said slot and pin when said link parts are in said extended position.

6. A display and burial system comprising, a base having a frame member along at least one end thereof, a lid member movable relative to said base between a closed position and an open viewing position, and means coacting between the base and the lid member for holding the lid member in viewing position, said means including a link having two parts which are pivotally connected together for movement between an extended generally straight-line relation and a collapsed relation, one link part being pivotally connected to said lid member, the other link part having an open-ended slot, a recess in said frame member having a pin therein extending parallel to the front of said base, said recess having a front to rear dimension adequate to permit entry of the other link part into said recess while the lid member is partially open and the link is partially collapsed to have said slot opening downwardly to pass over the pin and thereafter, as the lid member is fully opened and the links are pivoted to straight-line relation, the other link part pivots on said pin to a position where the slot opens toward the front of the base and an edge of the other link part engages an edge of said recess to prevent disengagement of the pin and slot, and means for preventing pivoting of said link parts beyond said straight-line relation.

7. A display and burial system comprising, a base having a frame member, a lid member movable relative to said base between a closed position and an open viewing position, and easily stored and released means coacting between the base and the lid member for holding the lid member in viewing position, said means including a link having two parts which are pivotally connected together for movement between an extended generally straight-line relation and a collapsed relation, one link part being pivotally connected to said lid member, a recess in said frame member having a pin therein extending generally parallel to the front of said base and said recess having a front to rear dimension adequate to permit entry of the other link part into said recess while the lid member is partially open and the link is partially collapsed, the other link part having pin-engaging means positioned to engage said pin as said other link part moves into said recess, and thereafter as the lid member is fully opened and the links are pivoted to straight-line relation said other link part pivots on said pin to a position where an edge of the other link part engages an edge of said recess and the other link part is locked to said pin.

* * * * *